US011156193B2

(12) United States Patent
Fisch et al.

(10) Patent No.: US 11,156,193 B2
(45) Date of Patent: Oct. 26, 2021

(54) FUEL PUMP ASSEMBLY WITH DIVERTED FLOW

(71) Applicant: Walbro LLC, Tucson, AZ (US)

(72) Inventors: Elton J. Fisch, Caro, MI (US); Douglas W. Salowitz, Jr., North Branch, MI (US); Edward J. Talaski, Caro, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 16/982,228

(22) PCT Filed: Mar. 19, 2019

(86) PCT No.: PCT/US2019/022846
§ 371 (c)(1),
(2) Date: Sep. 18, 2020

(87) PCT Pub. No.: WO2019/183017
PCT Pub. Date: Sep. 26, 2019

(65) Prior Publication Data

US 2021/0025359 A1 Jan. 28, 2021

Related U.S. Application Data

(60) Provisional application No. 62/645,215, filed on Mar. 20, 2018.

(51) Int. Cl.
*F02M 37/10* (2006.01)
*F02M 37/50* (2019.01)
(Continued)

(52) U.S. Cl.
CPC ..... *F02M 37/10* (2013.01); *F02M 37/50* (2019.01); *F02D 41/3082* (2013.01);
(Continued)

(58) Field of Classification Search
CPC ..... F02M 37/10; F02M 37/50; F02M 37/44; F02D 41/3082; F02D 2200/0602; F02D 2250/31
See application file for complete search history.

(56) References Cited

U.S. PATENT DOCUMENTS 5,024,188 A * 6/1991 Hartke ..... F02B 61/045 123/195 A
5,195,494 A 3/1993 Tuckey
(Continued)

FOREIGN PATENT DOCUMENTS

WO WO2013081784 A1 6/2013

OTHER PUBLICATIONS

Written Opinion & International Search Report for PCT/US2019/022846 dated Jul. 2, 2019, 9 pages.

*Primary Examiner* — Hieu T Vo
(74) *Attorney, Agent, or Firm* — Reising Ethington P.C.

(57) ABSTRACT

In at least some implementations, a fuel pump assembly includes a fuel pump having an inlet through which fuel enters the fuel pump and a first outlet from which pressurized fuel is discharged for delivery to an engine, and a second outlet through which some of the fuel discharged from the fuel pump is routed wherein that fuel is not delivered to the engine, wherein the second outlet has a flow area that permits a flow of fuel through the second outlet that is sufficient to reduce the maximum pressure of fuel downstream of the first outlet for delivery to an engine to between 1/10th and 1/25th of the output pressure of the fuel pump without flow through the second outlet.

19 Claims, 2 Drawing Sheets

(51) Int. Cl.
*F02M 37/44* (2019.01)
*F02D 41/30* (2006.01)

(52) U.S. Cl.
CPC .. *F02D 2200/0602* (2013.01); *F02D 2250/31* (2013.01); *F02M 37/44* (2019.01)

(56) References Cited

U.S. PATENT DOCUMENTS

| | | | | |
|---|---|---|---|---|
| 5,406,922 | A | 4/1995 | Tuckey | |
| 5,421,306 | A | 6/1995 | Talaksi | |
| 6,158,975 | A | 12/2000 | Dill et al. | |
| 6,343,589 | B1 * | 2/2002 | Talaski ..... | F02M 37/025 123/509 |
| 8,302,406 | B2 | 11/2012 | Baker | |

* cited by examiner

FUEL PUMP ASSEMBLY WITH DIVERTED FLOW

REFERENCE TO RELATED APPLICATIONS

This application claims the benefit of U.S. Provisional Application Ser. No. 62/645,215 filed on Mar. 20, 2018 the entire contents of which are incorporated herein by reference in its entirety.

TECHNICAL FIELD

The present disclosure relates generally to a fuel pump assembly in which a portion of the output fuel from the fuel pump is diverted and not supplied to an engine.

BACKGROUND

Vehicles typically include a fuel system with a fuel tank, a fuel pump that pumps fuel from the tank to a vehicle engine to support operation of the engine, and sometimes other components, such as a fuel level sensor, fuel pressure regulator, fuel injectors, fuel filter and the like. In some vehicles, the fuel pump is mounted within the vehicle fuel tank as part of a module or assembly that may include other components of the fuel system, such as the fuel level sensor and one or more fuel filters all carried on a common support structure. Some modules have been mounted in the fuel tank by a mounting flange received in an opening of a fuel tank and secured to a wall of the fuel tank. A high-pressure, electric motor driven fuel pump, that discharges fuel at 40 psi or more, may deliver fuel to a fuel rail which leads to fuel injectors for injection of the fuel into the engine, for example, in an automotive application. However, engines that are fed fuel from a carburetor or other low-pressure charge forming device cannot use fuel at such high pressure.

SUMMARY

In at least some implementations, a fuel pump assembly includes a fuel pump having an inlet through which fuel enters the fuel pump and a first outlet from which pressurized fuel is discharged for delivery to an engine, and a second outlet through which some of the fuel discharged from the fuel pump is routed wherein that fuel is not delivered to the engine, wherein the second outlet has a flow area that permits a flow of fuel through the second outlet that is sufficient to reduce the maximum pressure of fuel downstream of the first outlet for delivery to an engine to between $1/10^{th}$ and $1/25^{th}$ of the output pressure of the fuel pump without flow through the second outlet.

In at least some implementations, the fuel pump includes an electric motor and the power supplied to the motor is not varied to control the output of the fuel pump as a function of the power provided to the fuel pump. The fuel pump may include a pumping element driven by the fuel pump to discharge fuel from the pumping element under pressure, and the first outlet and second outlet may both receive fuel discharged from the pumping element. In at least some implementations, the fuel pressure downstream of the first outlet is 3 psi or less.

In at least some implementations, the second outlet includes or leads to a conduit through which fuel that flows through the second outlet is routed, and the conduit has an outlet that is directed toward the fuel pump inlet. A fuel filter may be coupled to the fuel pump to filter fuel before the fuel flows through the fuel pump inlet, and the outlet of the conduit may be directed at the filter.

In at least some implementations, the assembly includes a mounting flange is adapted to be coupled to a fuel tank wall, and a carrier, and the fuel pump is carried by the carrier and the carrier is connected to the mounting flange by one or more supports. The mounting flange may include a fluid fitting and one of the supports communicates with the first outlet and the fluid fitting to direct fuel from the first outlet to the fluid fitting.

In at least some implementations, the fuel pump includes an outlet end cap and the second outlet is defined in the outlet end cap or carried by the fuel pump. The first inlet may be defined at least in part by a fitting of the outlet end cap.

In at least some implementations, a passage is connected to the second outlet and the passage or second outlet includes or is coupled to a flow restrictor that controls the flow rate of fuel through the second outlet.

In at least some implementations, the second outlet is downstream of the fuel pump. And the second outlet may be defined by a port or passage that communicates with and directs some fuel away from a primary fuel path extending away from the first outlet.

In at least some implementations, the second outlet is defined by or communicated with a flow controller that controls the pressure and/or flow rate of fuel through the second outlet. The first outlet may be communicated with the flow controller, and the flow controller may be a pressure regulator that includes a bypass outlet through which fuel above a threshold pressure is bypassed from a primary fuel path that includes the first outlet.

In at least some implementations, a fuel system for supplying fuel to an engine includes a fuel tank having an interior arranged for receipt of a supply of fuel, a fuel pump, a fuel metering device and a second outlet. The fuel pump is received in the fuel tank interior, and has an inlet through which fuel enters the fuel pump and a first outlet from which pressurized fuel is discharged. The fuel metering device is in communication with the first outlet to receive at least some of the fuel discharged through the first outlet, and the fuel metering device is arranged to provide fuel to the engine to support operation of the engine. Some of the fuel discharged from the fuel pump is discharged through the second outlet and is routed back to the fuel tank interior. The second outlet has a flow area that permits a flow of fuel through the second outlet that is sufficient to reduce the maximum pressure of fuel delivered to the fuel metering device to between $1/10^{th}$ and $1/25^{th}$ of the output pressure of the fuel pump without flow through the second outlet. In at least some implementations, the pressure of fuel delivered to the fuel metering device is 3 psi or less.

BRIEF DESCRIPTION OF THE DRAWINGS

The following detailed description of certain embodiments and best mode will be set forth with reference to the accompanying drawings, in which.

DETAILED DESCRIPTION

Figure 1:
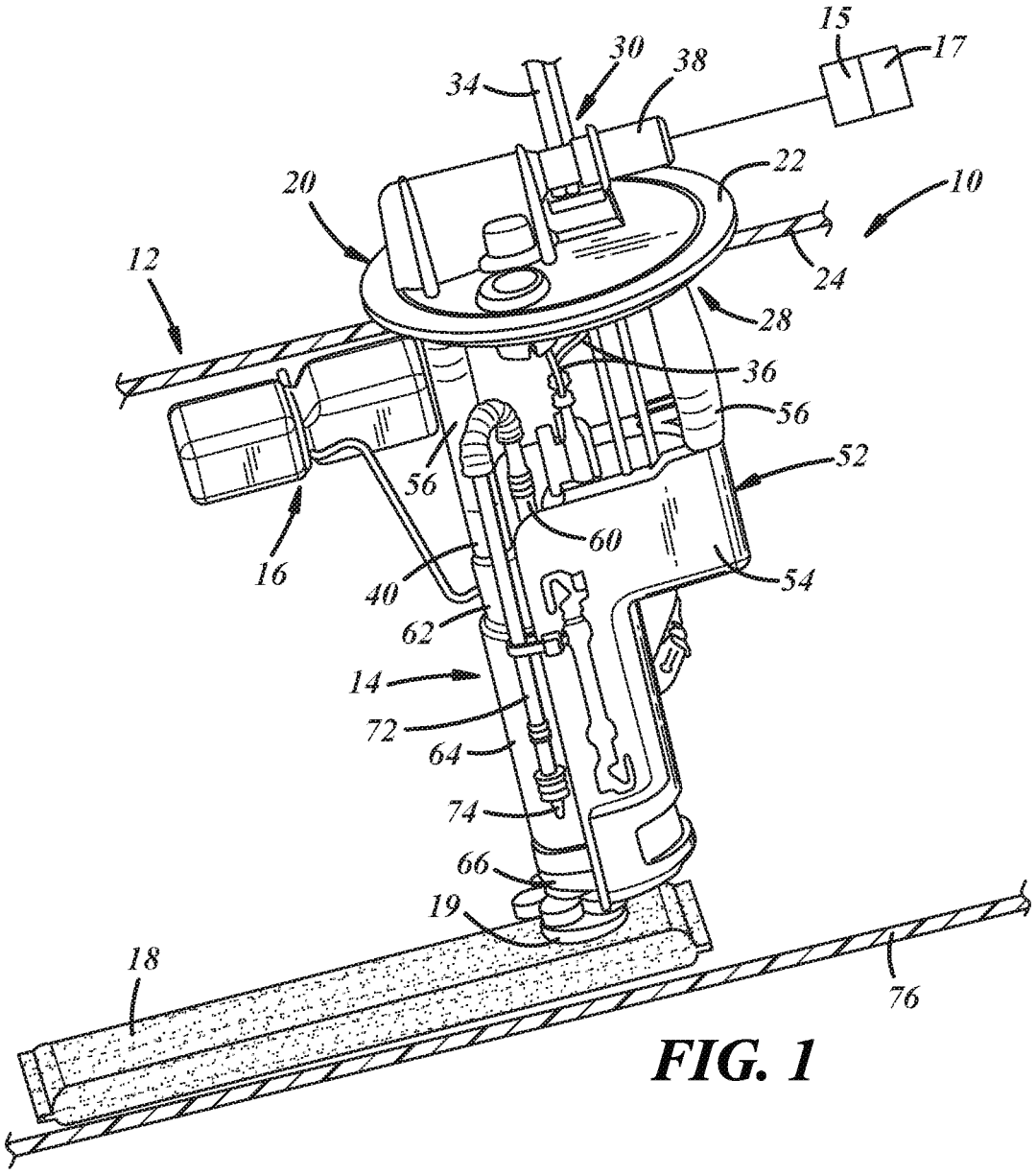
FIG. 1 is a perspective view of a fuel pump assembly.

Referring in more detail to the drawings, FIG. 1 illustrates a fuel pump assembly 10 that is constructed and arranged to be disposed at least partially within a vehicle fuel tank 12 (only part of which is shown), such as in a marine vehicle, snowmobile, ATV, motorcycle or automobile, which are non-limiting examples. The assembly 10 includes an electric motor driven fuel pump 14 that delivers fuel under pressure from the fuel tank 12 to a fuel control or metering device 15, such as a carburetor or fuel injector(s) to support operation of an engine 17. The fuel pump 14 may include a turbine type pumping element (e.g. a rotary impeller) used to pressurize the fuel, or any other suitable type, including but not limited to a positive displacement pump with gerotor or other pumping elements. The assembly 10 may also include a fuel level sender 16 that provides an indication of the amount of fuel within the fuel tank 12, and a fuel filter 18 that may filter fuel before that fuel is drawn into the inlet 19 of the fuel pump 14.

The fuel pump assembly 10 may include a mounting flange 20 having a radially outwardly extending lip 22 adapted to overlie and be sealed to a fuel tank wall 24, and other than the flange, the assembly 10 may be adapted to be received within an opening 28 of the fuel tank. An electrical connector or pass through region 30 may couple together wires 34 external to the fuel tank 12 with wires 36 within the fuel tank and connected to, for example, the fuel level sender 16 and the fuel pump 14. In this way, power may be provided to the components 14, 16 within the tank 12, and signals (e.g. indicative of fuel level) from the components may be provided to a location outside of the tank. A fluid fitting 38 with an internal passage may be provided on or molded with the mounting flange 20 and may communicate an outlet 40 of the fuel pump 14 with a fuel line through which fuel is delivered to the engine. The mounting flange 20 may be molded of a polymeric material suitable for use with a polymeric fuel tank 12, and to be sealed to a fuel tank wall 24, or the flange may be formed from metal or any other suitable material.

The fuel pump 14 may be supported by a carrier 52. The carrier 52 may have any desired shape and size. In the implementation shown, the carrier 52 includes a sidewall 54 that surrounds at least part of the fuel pump 14. The fuel pump 14 could be connected to the carrier sidewall 54 in any suitable way, including by a bracket, clip, band, fasteners or the like, so that the fuel pump is carried by and or retained in place relative to the carrier 52. To retain the position within the fuel tank 12 of the carrier 52 and fuel pump 14, the carrier and/or the fuel pump may be coupled to the mounting flange 20. In the example shown, one or more supports 56 extend between and are coupled to both the flange and the carrier 52 and/or fuel pump 14.

The fuel pump 14 may have an outlet fitting through which fuel is discharged from the fuel pump under pressure. The outlet fitting may be coupled to a support 56, which may be hollow or otherwise define a passage through which fuel discharged from the fuel pump outlet 40 is routed to the fluid fitting 38 on the flange 20. Instead of the support, a separate conduit may be provided between the fuel pump and fitting 38, or the fuel pump outlet 40 may be directly received within the passage of the flange 20 without any intervening conduit or support. The outlet fitting or other outlet from the fuel pump defines a first or main fuel outlet through which fuel is discharged for delivery to the engine to support engine operation.

Figure 2:
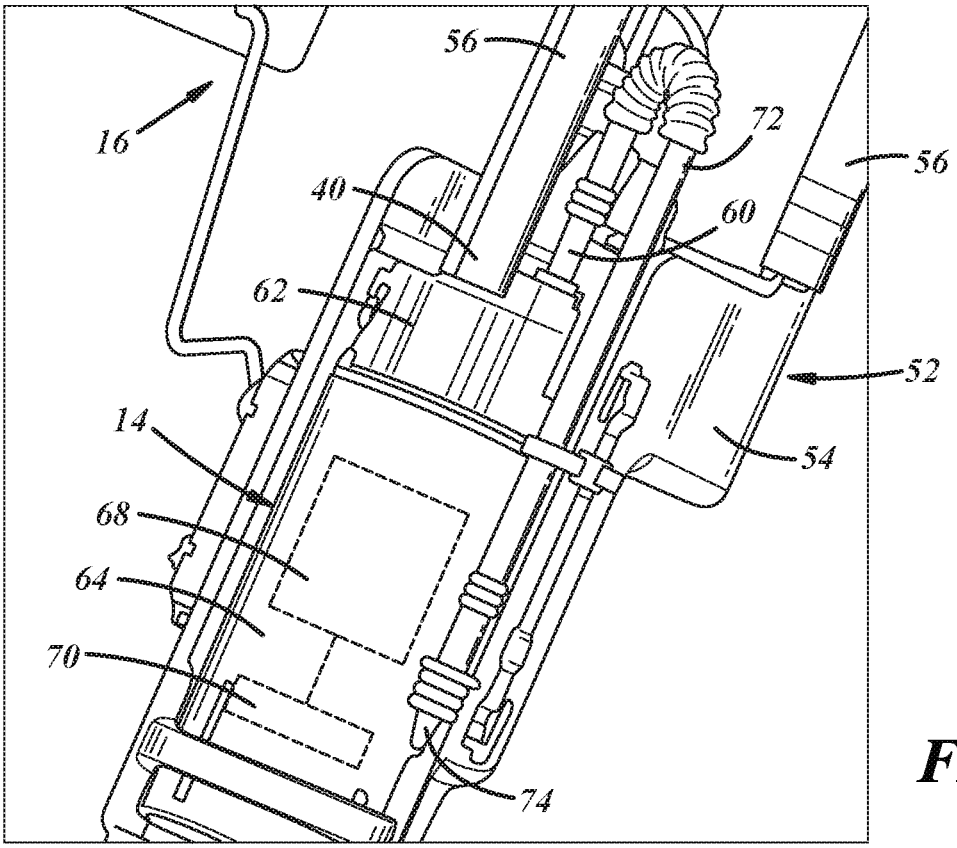
FIG. 2 is an enlarged perspective view of a portion of the fuel pump assembly.
Figure 3:
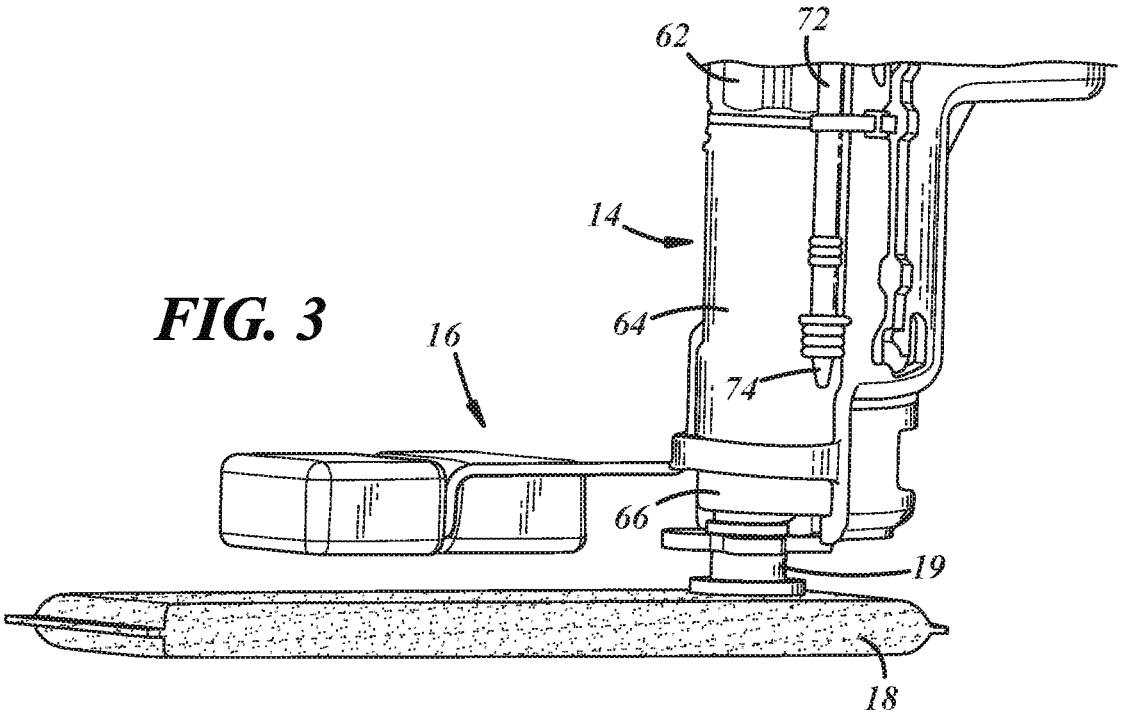
FIG. 3 is another enlarged perspective view of a portion of the fuel pump assembly.

In at least some implementations, the fuel pump assembly 10 includes a second outlet 60 through which pressurized fuel discharged from the fuel pump 14 is routed. The second outlet 60 may be defined in or carried by the fuel pump 14. In the example shown, the fuel pump 14 includes an outlet end cap 62 which is coupled to a casing 64 which is also coupled to an inlet end cap 66. The casing 64 may be cylindrical and open at one or both ends, with the inlet end cap 66 arranged at one end of the casing and the outlet end cap 62 arranged at the opposite end. An electric motor 68 (diagrammatically shown in dashed lines in FIG. 2) is received within an interior of the casing 64 between the end caps 62, 66, as is a pumping element 70 which is driven for rotation by the motor 68 to take in fuel from the tank, pressurize the fuel and discharge the fuel under pressure through one or both fuel outlets 40, 60. The inlet end cap 66 defines an inlet port 19 or passage through which fuel is drawn into the fuel pump 14, and, in the implementation shown in FIGS. 1-3, the outlet end cap includes the fitting that defines the main fuel outlet 40, and a second fitting which defines the second fuel outlet 60.

In at least some implementations, fuel discharged from the second fuel outlet 60 is not directed to the engine. Instead, fuel from the second outlet 60 is routed back into the fuel tank 12 and is therefore available to be pumped again by the fuel pump 14. In the example shown, a conduit, passage or tube 72 is connected to the second fitting so that fuel discharged from the second fuel outlet 60 flows into and through the tube 72. The tube 72, second fitting or second outlet 60 may include or be coupled to a flow restrictor 74 that controls the flow rate of fuel through the second outlet 60 and tube 72. The flow restrictor is not necessary and the second fuel outlet 60 or the tube 72 may be constructed to provide a desired fuel flow area to enable a desired fuel flow rate through the second fuel outlet. The ultimate outlet from the tube 72 or other flow controller or restrictor 74 may be directed within the fuel tank 12 as desired. In the example shown, the end of the tube 72 includes a nozzle or other reduced diameter orifice that defines a flow restrictor 74 and is directed toward the fuel filter 18 and a bottom wall 76 of the fuel tank. This keeps the fuel directed away from an upper wall 24 of the tank 12 to which the flange 20 is coupled, and through which a fuel fill element may extend, where the fuel fill element is an orifice or passage through which fuel is added to interior of the fuel tank. Another benefit to directing the flow toward the inlet filter 18 and/or pump inlet 19 may be to make more fuel available to the fuel pump inlet 19 (e.g. where the fuel tank 12 is at an angle at which fuel in the tank tends to flow away from the pump inlet, providing fuel flow in the area of the filter and pump inlet may help ensure fuel is available at the pump inlet). As noted above, the flow restrictor 74 may also be provided within the fuel pump, such as by a reduced diameter port in the outlet end cap, a reduced diameter portion of a fitting on the outlet end cap to which the tube 72 is connected, or a jet or other restriction in the outlet end cap, fitting, or the end of the tube coupled to the outlet end cap.

Figure 4:
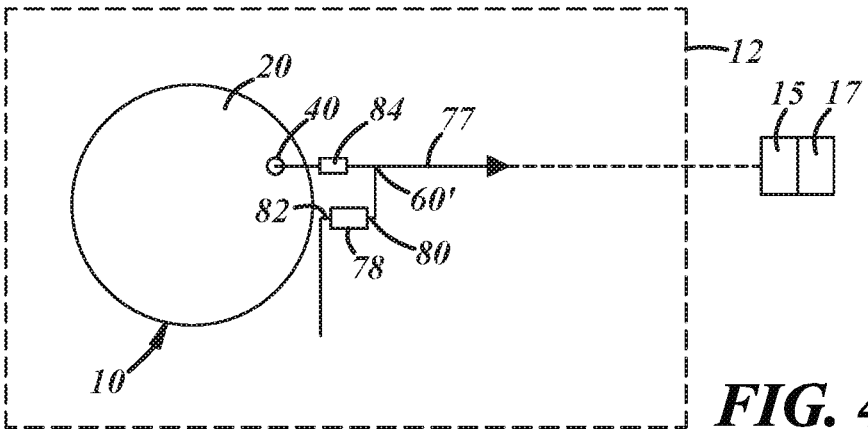
FIG. 4 is a diagrammatic view of the fuel pump assembly.

In some implementations, the second outlet 60 may be downstream of and not directly associated with the fuel pump 14. For example, as shown in FIG. 4, the second outlet 60' may be defined by a port or passage that communicates with and directs some fuel away from a primary fuel path 77 between the fuel pump outlet 40 and the engine. In at least some implementations, the second outlet 60' is provided either within or outside the fuel tank 12, and fuel that flows through the second outlet is returned to the fuel tank interior as noted above. A restriction in or downstream of the second outlet 60' or the size of the second outlet itself may limit the flow rate or pressure of fuel through the second outlet 60'.

The second outlet 60' may be defined by or communicate with a flow controller, such as a pressure regulator 78. Fuel from the primary fuel path 77 may be communicated with the pressure regulator 78 via the second outlet 60', which may define or lead to an inlet 80 of the pressure regulator. The pressure regulator also has a bypass outlet 82 through which fuel is discharged and returned to the fuel tank. In at least some implementations, the regulator 78 is located within the fuel tank 12 and the bypass outlet 82 directly opens into the fuel tank interior in a so-called no-return fuel system (when the fuel pump 14 and/or bypass regulator 78 are received within the fuel tank). In other implementations, the regulator 78 may be located outside of the fuel tank 12 and the bypass outlet 82 may lead to a fuel line through which fuel is directed back to the fuel tank interior in a return-type fuel system. This may be useful, for example, in systems that have smaller fuel tanks or for other reasons.

If it is desired to maintain some pressure in the primary fuel path 77 downstream of the fuel pump main outlet, a check valve 84 may be provided either in the fuel pump 14, or downstream of the fuel pump. The second outlet 60, 60' may be downstream of the check valve 84 to prevent fuel from draining through the primary fuel path 77 but allowing fuel flow through the regulator 78, if desired. The check valve 84 permits fluid flow in the direction leading to the engine but prevents fuel flow in the opposite direction, to avoid draining through the primary fuel path 77. Where the pressure regulator 78 is adjacent to the primary fuel path 77 (e.g. the regulator has an inlet and a first outlet in the bypass fuel path so that all fuel in the bypass fuel path flows through the inlet and primary outlet, and the regulator has a bypass outlet through which some fuel may be bypassed to the tank 12) the pressure regulator may define the check valve in that it may close when fuel upstream of the pressure regulator is not above a threshold pressure, and may open only when the fuel entering the pressure regulator is above the threshold pressure. In this situation, the bypass outlet may be considered to define a second outlet of the regulator 78. In other implementations, a check valve or other valve is not needed as the fuel in the primary fuel path 77 may drain and the pressure in the primary fuel path can decrease without affecting system operation. For example, the primary fuel path 77 may lead from the fuel pump 14 to a float bowl of a carburetor that acts as the metering device 15 for the engine 17. The float bowl inlet may be above a certain height such that all, most or at least some fuel remains in the float bowl and does not drain. And/or the carburetor may have a suitable valve to prevent draining of the fuel from the float bowl.

In at least some implementations, the fuel pump 14 may provide an output fuel pressure and flow rate that exceeds the maximum system demand, that is, the maximum fuel consumption by the engine. In that case, some of the outputted fuel from the fuel pump 12 needs to be diverted and not delivered to the engine. In at least some implementations, the fuel pump 14 may provide an output fuel pressure that is between 10 and 25 times higher than the pressure needed for the fuel supply to the engine. For example, a fuel pump may provide an output fuel pressure of between 20 psi and 50 psi while the final fuel delivery mechanism for the engine, such as a carburetor, may need fuel at 3 psi or less. To permit use of such a fuel pump in a carburetor fuel supply system, the pressure is reduced by diverting fluid flow through the second fuel outlet 60, 60'.

In at least some implementations, the rate at which fuel is diverted is chosen to ensure that at least two threshold conditions are satisfied. One threshold condition is the minimum pressure required in the system when the engine fuel consumption is at its maximum. Another threshold condition is the maximum pressure permitted in the system when the engine fuel consumption is at its minimum. When engine consumption is at its minimum value, the flow rate of fuel bypassed or diverted through the second fuel outlet 60, 60' is at its greatest value. When engine consumption is at its maximum value, the flow the flow rate of fuel bypassed or diverted through the second fuel outlet 60, 60' is at its lowest value. Thus, in such implementations, the port, orifice or flow path via which fuel is bypassed or diverted must be of sufficient size to permit the maximum bypassed or diverted flow rate during periods of minimum engine consumption and also not too large so as to divert too much flow such that the engine's maximum fuel demand or consumption cannot be supported. In at least some implementations, the net system pressure decreases at maximum engine consumption based on the combination of the fuel pumps output characteristics and the combined flow to the engine and through the second fuel outlet 60, 60'.

In at least some implementations, the fuel pump 14 may be capable, when new, of providing between 120% and 250% the flow rate of fuel needed to supply the maximum engine fuel demand. For example, if the maximum engine fuel demand is 50 liters per hour, the fuel pump 14 may be capable of providing a fuel flow rate of 60 liters per hour to 125 liters per hour or more. Accordingly, even during periods of maximum fuel consumption by the engine, 50 liters per hour of fuel may be bypassed, and during periods of minimum engine fuel consumption, up to 124 liters per hour may be bypassed. In at least some implementations wherein the fuel pump 14 provides fuel to a carburetor that in turn provides fuel to the engine, the minimum cross-sectional flow area (transverse to direction of fuel flow) of the second outlet 60, 60', or a restriction in the flow path including the second fuel outlet is between 1 $mm^2$ and 8 $mm^2$. Of course, these values are merely examples of one or some systems and other values may be used in other systems.

In at least some implementations, the greater than needed fuel flow rate can be provided to ensure that the fuel pump 14 can meet maximum engine fuel demand over time, for example, when the fuel pump ages and performance deteriorates, when fuel filter(s) become dirty and clogged which may reduce pump efficiency, if the voltage supplied to the fuel pump is reduced in certain instances (e.g. when cold), or to overcome other reductions in performance. The increased fuel flow may also help cool the fuel pump 14 as the greater rate of liquid fuel flow may enable greater heat transfer from the pump motor 68. Some higher flow rate and lower pressure fuel pumps are more expensive than typical higher flow rate and higher pressure fuel pumps such as those commonly used and mass produced for automotive applications. Thus, a less expensive pump may be used with the systems described herein. Further, the lower pressure at which the pump may operate requires a lower current demand by the pump and can increase the useful life of the fuel pump. These are just some benefits, one or more of which may be realized in some implementations of fuel pump assemblies 10 as set forth herein.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A fuel pump assembly, comprising:

a fuel pump having an inlet through which fuel enters the fuel pump and a first outlet from which pressurized fuel is discharged for delivery to an engine; and a second outlet through which some of the fuel discharged from the fuel pump is routed wherein that fuel is not delivered to the engine, wherein the second outlet has a flow area that permits a flow of fuel through the second outlet that is sufficient to reduce the maximum pressure of fuel downstream of the first outlet for delivery to an engine to between $1/10^{th}$ and $1/25^{th}$ of the output pressure of the fuel pump without flow through the second outlet.

2. The assembly of claim 1 wherein the fuel pump includes an electric motor and the power supplied to the motor is not varied to control the output of the fuel pump as a function of the power provided to the fuel pump.

3. The assembly of claim 2 wherein the fuel pump includes a pumping element driven by the fuel pump to discharge fuel from the pumping element under pressure, and wherein the first outlet and second outlet both receive fuel discharged from the pumping element.

4. The assembly of claim 1 wherein the fuel pressure downstream of the first outlet is 3 psi or less.

5. The assembly of claim 1 wherein the second outlet includes or leads to a conduit through which fuel that flows through the second outlet is routed, and wherein the conduit has an outlet that is directed toward the fuel pump inlet.

6. The assembly of claim 5 which also includes a fuel filter coupled to the fuel pump and through which fuel flows before flowing through the fuel pump inlet, and wherein the outlet of the conduit is directed at the filter.

7. The assembly of claim 1 which also includes a mounting flange adapted to be coupled to a fuel tank wall, and a carrier, wherein the fuel pump is carried by the carrier and the carrier is connected to the mounting flange by one or more supports.

8. The assembly of claim 7 wherein the mounting flange includes a fluid fitting and one of the supports communicates with the first outlet and the fluid fitting to direct fuel from the first outlet to the fluid fitting.

9. The assembly of claim 1 wherein the fuel pump includes an outlet end cap and the second outlet is defined in the outlet end cap or carried by the fuel pump.

10. The assembly of claim 9 wherein the first inlet is defined at least in part by a fitting of the outlet end cap.

11. The assembly of claim 1 which includes a passage connected to the second outlet and wherein the passage or second outlet includes or is coupled to a flow restrictor that controls the flow rate of fuel through the second outlet.

12. The assembly of claim 1 wherein the second outlet is downstream of the fuel pump.

13. The assembly of claim 12 wherein the second outlet is defined by a port or passage that communicates with and directs some fuel away from a primary fuel path extending away from the first outlet.

14. The assembly of claim 1 wherein the second outlet is defined by or communicated with a flow controller that controls the pressure and/or flow rate of fuel through the second outlet.

15. The assembly of claim 14 wherein the first outlet is communicated with the flow controller, and the flow controller is a pressure regulator that includes a bypass outlet through which fuel above a threshold pressure is bypassed from a primary fuel path that includes the first outlet.

16. A fuel system for supplying fuel to an engine, comprising:

a fuel tank having an interior arranged for receipt of a supply of fuel;

a fuel pump received in the fuel tank interior, the fuel pump having an inlet through which fuel enters the fuel pump and a first outlet from which pressurized fuel is discharged;

a fuel metering device in communication with the first outlet to receive at least some of the fuel discharged through the first outlet, the fuel metering device being arranged to provide fuel to the engine to support operation of the engine;

a second outlet through which some of the fuel discharged from the fuel pump is routed back to the fuel tank interior, wherein the second outlet has a flow area that permits a flow of fuel through the second outlet that is sufficient to reduce the maximum pressure of fuel delivered to the fuel metering device to between $1/10^{th}$ and $1/25^{th}$ of the output pressure of the fuel pump without flow through the second outlet.

17. The system of claim 16 wherein the pressure of fuel delivered to the fuel metering device is 3 psi or less.

18. A fuel pump assembly, comprising:

a fuel pump having an inlet through which fuel enters the fuel pump and a first outlet from which pressurized fuel is discharged for delivery to an engine; and a second outlet through which some of the fuel discharged from the fuel pump is routed wherein that fuel is not delivered to the engine, wherein the second outlet has or is communicated with a restriction that permits a flow of fuel through the second outlet that is sufficient to reduce the maximum flow rate of fuel downstream of the first outlet for delivery to an engine without changing the pressure of fuel delivered from the pump by more than 5%.

19. The assembly of claim 18 which also includes a pressure regulator coupled to one or both of the first outlet and second outlet and arranged to maintain a constant pressure of fuel downstream of the pressure regulator that is delivered to the engine.

* * * * *